US006200416B1

(12) United States Patent
Brotto et al.

(10) Patent No.: US 6,200,416 B1
(45) **Date of Patent: *Mar. 13, 2001**

(54) RECYCLED PAPER PRODUCTION PROCESS WHICH INCORPORATES CARBON DIOXIDE

(75) Inventors: Jefferson Luis Brotto, Sao Paulo; Douglas Barbosa Madeiros; Alexandre Sayao Valladares, both of Rio de Janeiro, all of (BR); John Allen Slocumb, Lockport, IL (US)

(73) Assignee: Praxair Technology, Inc., Danbury, CT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/872,322

(22) Filed: Jun. 10, 1997

(Under 37 CFR 1.47)

(51) Int. Cl.[7] ..... D21H 11/14; D21B 1/08
(52) U.S. Cl. ..... 162/4; 162/5; 162/8
(58) Field of Search ..... 162/4, 5, 7, 8, 162/63, 90

(56) References Cited

U.S. PATENT DOCUMENTS

| | | | | |
|---|---|---|---|---|
| 1,298,779 | | 4/1919 | Osborne . | |
| 1,753,690 | | 4/1930 | Brown . | |
| 1,993,265 | | 3/1935 | Dyer | 92/21 |
| 2,114,809 | | 4/1938 | Rawling | 92/21 |
| 3,619,347 | | 11/1971 | Ireland | 162/5 |
| 5,139,613 | * | 8/1992 | Lachapelle | 162/60 |
| 5,308,448 | | 5/1994 | Behler et al. | 162/7 |
| 5,364,501 | | 11/1994 | Baret et al. | 162/5 |
| 5,378,322 | | 1/1995 | Hornsey | 162/158 |
| 5,401,360 | | 3/1995 | Galland | 162/8 |
| 5,429,717 | | 7/1995 | Bokstrom et al. | 162/60 |
| 5,505,819 | | 4/1996 | De Witt et al. | 162/142 |
| 5,772,847 | * | 6/1998 | Simpson et al. | 162/189 |

FOREIGN PATENT DOCUMENTS

| | | | |
|---|---|---|---|
| 0281273 | 9/1988 | (EP) | D21H/3/74 |

* cited by examiner

*Primary Examiner*—Dean T. Nguyen
(74) *Attorney, Agent, or Firm*—Donald T. Black

(57) ABSTRACT

A method for the manufacture of paper products includes the feeding of a carbon dioxide stream to a product flow which includes a material containing an aluminum compound. The material is preferably wastepaper containing aluminum sulfate or papermaker's alum. The material may also be a product flow of wastepaper (containing aluminum sulfate) to which a supply of virgin pulp has been added. The carbon dioxide addition to the product flow reduces the pH of the product flow to a level of acidity which allows a dissolution of the aluminum compound and incorporation thereof throughout the product flow.

6 Claims, 1 Drawing Sheet

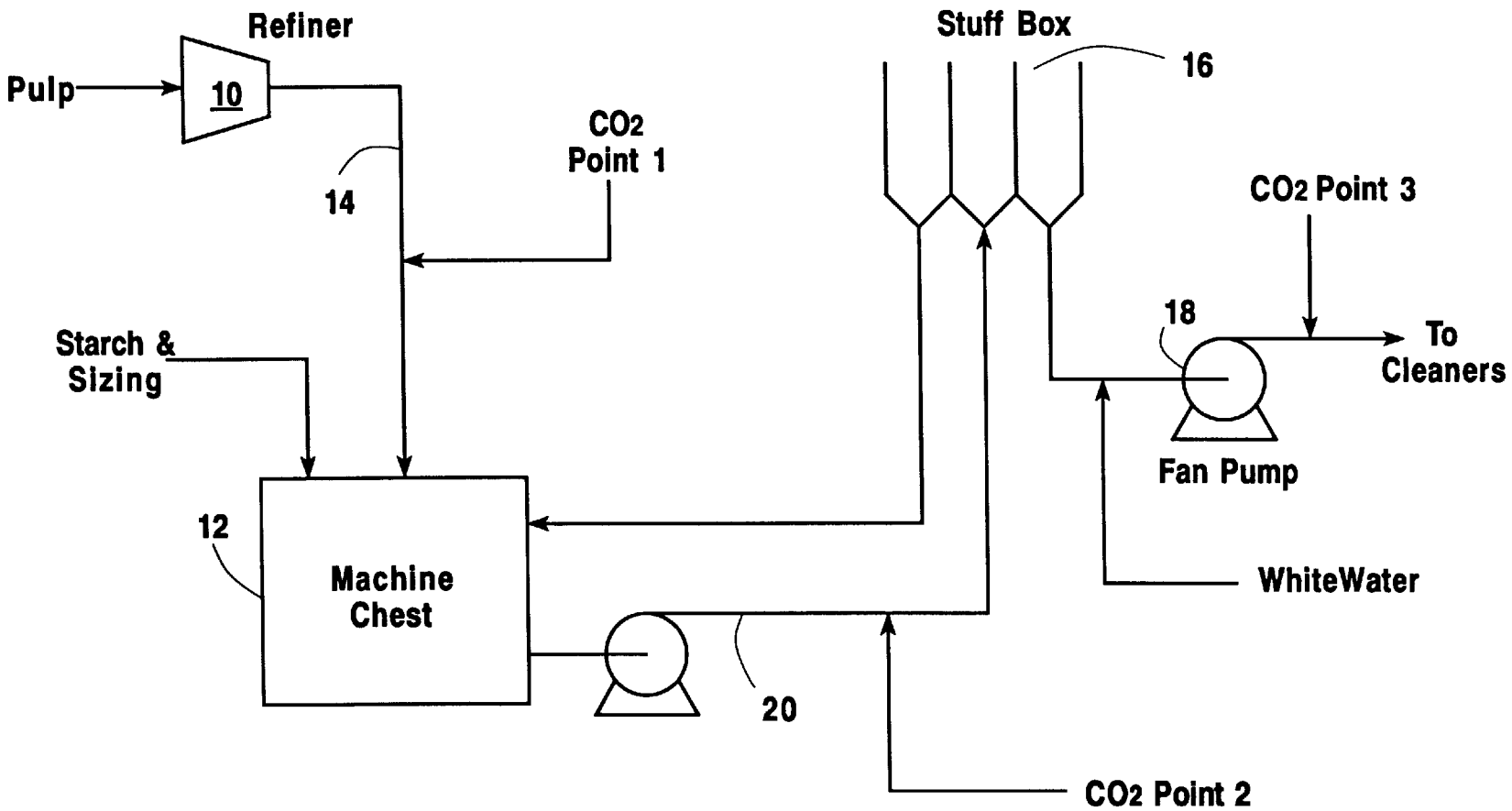
Pulp
Refiner
10
14
CO2 Point 1
Starch & Sizing
Machine Chest
12
20
CO2 Point 2
Stuff Box
16
18
Fan Pump
WhiteWater
CO2 Point 3
To Cleaners

RECYCLED PAPER PRODUCTION PROCESS WHICH INCORPORATES CARBON DIOXIDE

FIELD OF THE INVENTION

This invention relates to a method for the manufacture of a paper product and, more particularly, to a method for the manufacture of a paper product wherein addition of acidifying aluminum compounds is minimized through the use of a carbon dioxide addition.

BACKGROUND OF THE INVENTION

Papermaking is the process of converting a raw cellulosic material, typically wood pulp, into paper or board. Hereafter, the terms paper product, pulp product, or simply product will be used to denote any final product made from a cellulosic material. In other words, a paper or pulp product can be either paper or board. Paper products can be made from a variety of raw materials, the most popular of which are wood-containing materials. Paper products may also be produced from non-wood materials such as straw, cotton, etc . . .

Many methods are available for preparing a virgin pulp slurry from wood and non-wood materials. Such methods are generally classed as either mechanical, chemical, or hybrid. In addition to virgin pulps, recycled pulps, also called secondary fibers, are available for making a pulp slurry. Examples of sources of secondary fibers are old newspapers, old corrugated containers and mixed office waste. Paper products can be made from 100% recycled material, 100% virgin material, or mixtures of both virgin and recycled material.

Hereafter, terms known in the papermaking art will be used and definitions of those terms can be found in the Appendix hereto. Paper products are made by taking a pulp slurry, a mixture of water and cellulosic material, and running it through a series of process steps, among which are refining, mixing, pumping, cleaning, diluting, thickening, draining, pressing, drying, and winding. During processing, various additives are incorporated into the furnish; examples of these additives are dyes, fillers, starches, pH adjusters, and sizes.

Two papermaking processes are generally in use: an acid-based process and an alkaline-based process. Alkaline papermaking involves the addition of neutral or alkaline chemicals, typically calcium carbonate and alkylketene dimer (AKD) size, to the pulp furnish. By contrast, acid papermaking is a process in which the pulp furnish pH is slightly acidic. Papermakers generally use aluminum sulfate and rosin size in acid-based papermaking.

Aluminum sulfate, or papermaker's alum, is a common filler in acid papermaking and serves two main functions. It reduces pH, which improves drainage on the wire section of the paper machine, and it fixes additives such as dyes and rosin, thus improving retention of fines, sizes, and other fillers. Alum, or more specifically, the hydrated complex of the aluminum ion, undergoes hydrolysis in solution according to the following reaction:

$$[Al(H_2O)_6]^{3+} \rightarrow [Al(H_2O)_5(OH)]^{2+} + H^+ \quad (1)$$

This reaction represents an acid dissociation and is the method by which the aluminum sulfate adjusts pH in the acid papermaking process. pH adjustment is necessary for optimal retention of the size. In a typical alum-rosin sizing system, pH is lowered below 5.0, usually around 4.5. A consequences of this pH adjustment is that drainage on the wire section of the paper machine is improved.

The aluminum product of the above reaction, $[Al(H_2O)_5(OH)]^{2+}$, is crucial in the next step of rosin sizing. The product undergoes a series of complicated polymer reactions to serve as a mordant which combines with the rosin to form an insoluble complex. This complex in turn fixes the rosin to the fiber structure and enhances retention of the rosin. The complex is also useful in retaining fines because the complex can bridge multiple cellulose molecules, forming a larger compound which is retained on the wire rather than washed out of the solution.

Because of the dual nature of papermaker's alum and the ease with which it is administered, papermakers tend to overfeed alum to accomplish retention of the size, adjustment of pH, and an increase in drainage. This propensity is especially true in the manufacture of paper products from wastepaper composed primarily of acid-sized paper products. Wastepaper of this composition, typically kraft papers such as cardboard and linerboard, already contains sufficient alum to complex with a portion of the additional size that will be added in stock preparation. Therefore, additional alum serves primarily to adjust the pH of the stock solution and to increase wire drainage.

Overuse of aluminum sulfate, however, can present a number of problems, namely:

- aluminum sulfate is a relatively hazardous chemical, increasing the potential for possible operator injury;
- it is corrosive and increases the maintenance cost of papermaking equipment;
- it is relatively expensive;
- it reacts to form sulfuric acid, making it easy to over-acidify the pulp solution;
- excess aluminum sulfate leaving with the finished product reacts with moisture to produce sulfuric acid which attacks the pulp fibers and degrades the paper product;
- the sulfate portion of the aluminum sulfate can accumulate in the white water system, causing production and maintenance problems; and
- excess aluminum sulfate can form flocs in the fiber suspension and promote defects in sheet formation and in the finished paper product.

U.S. Pat. No. 1,753,690 to Brown is indicative of the prior art which employs aluminum sulfate to assist in the production of paper. The Brown patent discloses the use of a mixture of waste wax paper and fresh fibers, such as mixed paper or sulfite paper fiber. The mixture is heated to a temperature sufficiently high to soften the rosin contained in the wastepaper. The heated mixture of fibers is beaten to effect a disintegration of the paper, additional rosin is added and a solution of sodium silicate is also added to produce a dispersion. The mixture is then cooled to a temperature before the gelation point of the dispersed particles. Aluminum sulfate is then added in an amount to produce a slightly acid reaction. The aluminum sulfate reacts with the sodium silicate to produce a flocculent precipitate which carries the dispersed particles of waterproofing material that are contained in the wastepaper into the fibers.

U.S. Pat. No. 5,505,819 to DeWitt discloses a method of using acid, preferably phosphoric acid, in a papermaking process, in conjunction with bentonite and a suitable polymer. Dewitt shows that increased drainage can be attained by controlling the pH of an alkaline or neutral papermaking process in the range of 6.7 to 7.5.

U.S. Pat. No. 5,378,322 entitled "Carbon Dioxide in Neutral and Alkaline Sizing Processes" to Hornsey discloses a method for sizing paper with alkylketene dimer size and $CO_2$ in an alkaline environment. Hornsey nowhere indicates that $CO_2$ can be used with acid sizes such as alum.

As above indicated, excessive use of aluminum sulfate not only degrades the paper's quality, but also increases the maintenance costs of the papermaking equipment. Further, if the pH begins to fluctuate as a result of the strong acidic characteristic of the aluminum sulfate product, i.e., sulfuric acid, such fluctuations directly affect de-watering and impair the papermaker's ability to control the process.

Accordingly, it is an object of this invention to provide an improved papermaking process which minimizes the addition of aluminum sulfate to the pulp furnish.

It is another object of this invention to provide an improved method of papermaking which improves the paper product's ultimate resistance to deterioration.

It is yet another object of this invention to provide an improved method of papermaking which reduces the potential for defects resulting from flawed dispersion in the finished product.

SUMMARY OF THE INVENTION

A method for the manufacture of paper products includes the feeding of a carbon dioxide stream to a product flow which includes a material containing an aluminum compound. The material is preferably wastepaper containing aluminum sulfate or papermaker's alum. The material may also be a product flow of wastepaper (containing aluminum sulfate) to which a supply of virgin pulp has been added. The carbon dioxide addition to the product flow reduces the pH of the product flow to a level of acidity which allows a dissolution of the aluminum compound and incorporation thereof throughout the product flow.

BRIEF DESCRIPTION OF THE DRAWING

The FIGURE is a simplified version of a paper machine approach system which incorporates the invention.

DETAILED DESCRIPTION OF A PREFERRED EMBODIMENT

The invention employs a feed of carbon dioxide as a substitute for aluminum sulfate $Al_2(SO_4)_3$ in the production of papers made from wastepaper, virgin pulp or mixtures of wastepaper and virgin pulp. Certain types of wastepapers, i.e., wastepapers from an acid papermaking process, incorporate a high residual content of aluminum sulfate. When these wastepapers are pulped and used to make new paper, with or without the addition of virgin pulp, the invention utilizes an addition of carbon dioxide to the pulp furnish as a substitute for the addition of aluminum sulfate. A portion of the aluminum sulfate necessary for retention of the rosin size is already present in the furnish from the addition of the wastepaper. Thus, the pH lowering action and resulting acidity increase provided by a carbon dioxide addition to the furnish is sufficient to achieve sizing of the paper product.

In a first embodiment of the invention, wastepaper containing a high residual content of aluminum sulfate is blended with a virgin pulp. The amount of wastepaper blended with the virgin pulp is adjusted to complex with any rosin size added in a subsequent papermaking operation. In this way, additional aluminum sulfate is not necessary, and carbon dioxide is added to the furnish to adjust pH and increase drainage.

In a second embodiment of the invention, wastepaper containing aluminum sulfate is blended with virgin pulp. However, if aluminum sulfate is not present in sufficient quantity, enough additional aluminum sulfate is blended into the pulp slurry to obtain the amount required to complex with the additional rosin size. Carbon dioxide is added to the pulp slurry, normally before addition of the aluminum sulfate, to achieve a desired pulp pH range.

In a third embodiment of the invention, the pulp slurry contains 100% recycled pulp, with no virgin fibers added. Carbon dioxide is added to the pulp slurry to achieve a desired pulp pH range. Typically, enough aluminum sulfate exists within the recycled pulp that no additional alum is required. If sufficient aluminum sulfate is not present to complex with the additional size, then sufficient alum is added.

In a fourth embodiment of the invention, carbon dioxide is added to a slurry of virgin pulp to which a sizing agent has been added. The carbon dioxide enables the slurry to reach a desired pH range. Thereafter, aluminum sulfate is added to the slurry in such an amount as to react completely with the sizing agent.

When using carbon dioxide, an increase occurs in the quality of the resultant paper product. Carbon dioxide leads to the formation of a weak acid, i.e., carbonic acid, when water reacts with the carbon dioxide. Such a weak acid does not attack cellulose fibers to the same extent that strong acids do. Aluminum sulfate, a salt with strong acidic characteristics, does, in fact, attack the fibers. Further, papers manufactured with excessive aluminum sulfate are prone to attack by sulfuric acid which forms when the residual sulfate reacts with humidity. This reaction reduces the water resistance and the quality of the final paper product. When using carbon dioxide, this problem is avoided.

The use of carbon dioxide also decreases defects in the final paper product, as an excess of aluminum sulfate can cause problems with sheet formation, such as flawed dispersion, etc. Because carbon dioxide forms a weak acid, stock pH is easily controlled. In addition, carbonic acid tends to buffer out at moderately acidic pHs. This fact, coupled with improved control, makes it difficult to overshoot the pH target. Improved pH stability results, ensuring better dewatering and making it possible to increase the speed of the paper machine. Alternately, the increased dewatering rate translates into improved water removal on the Fourdrinier. In this way, less energy is required to evaporate water in the dryer section of the paper machine, resulting in improved economics.

Referring now to the FIGURE, a mixture of virgin and recycled pulp is sent to a refiner 10 which refines the pulp mixture to the papermaker's normal specifications. The refined pulp mixture then passes to a machine chest 12 where various additives, such as starch and size (e.g. rosin) are incorporated into the furnish. At this point, carbon dioxide can be injected into the furnish through the spargers or injectors that are incorporated into a conduit 14.

It is important to understand that the specific point for injection of carbon dioxide is not critical and, as will be hereafter understood, feed points for the carbon dioxide can be at various locations throughout the papermaking process.

The furnish is pumped from machine chest 12 to a stuff box 16 which serves to create a constant head for a fan pump 18 and a basis-weight valve (not shown). Carbon dioxide can also be added, via conduit 20, as the furnish is pumped to stuff box 16. As the furnish is pumped from the stuff box, it is diluted by the addition of white water and is pumped by fan pump 18 to the cleaners, in the known manner. Note that carbon dioxide can also be added at the outlet of fan pump 18.

The carbon dioxide injection points serve the same purpose, that is, to acidify the furnish. The injection points indicated in the FIGURE may be used, individually, or they may be used in combination. If only one injection point is used, a pH probe is placed far enough downstream of the injection point to enable control of the carbon dioxide injection flow rate. If multiple injection points are used, (e.g., two) pH probes and controllers are used for each injection point, so as to assure that the final acidity target is achieved.

In the case of the use of two injection points, the second (or downstream) injection point should supplement the first. That is, the furnish should be acidified to the lowest possible pH value, within economic limits, down to a set point value using the first location. The second injection site will further reduce the pH to the desired operating range.

The carbon dioxide injection point (or points) is chosen based upon specific mill conditions which provide the greatest opportunity for mixing. Note that the injection point locations shown in the FIGURE are not the only possible injection locations. One skilled in the art of carbon dioxide injection and mixing technology will be able to identify a best location based upon mill conditions. Note further that it is not important whether the carbon dioxide injection is applied before or after the addition of starch and supplemental size. However, it is preferred that the carbon dioxide be added before the addition of aluminum sulfate.

Temperature, pressure and stock flow rates are not important. These parameters may be set to the mill's specifications, as the use of carbon dioxide does not alter the parameters from their normal values. A preferred addition rate for carbon dioxide is on the order of about 5 kilograms of carbon dioxide per ton of pulp furnish, but can vary anywhere from about two to about ten kilograms per ton depending upon the specific process conditions. The amount of wastepaper pulp is important and is to be taken into consideration when determining the amount of carbon dioxide addition, as the included aluminum sulfate therein directly affects the resultant pH of the furnish.

Experimental

To study the effects caused by the substitution of carbon dioxide for aluminum sulfate $Al_2(SO_4)_3$, a variety of laboratory tests were performed.

Using pulp prepared from Kraft and corrugated wastepaper, samples were prepared using $Al_2(SO_4)_3$ and $CO_2$ to perform dewatering and size tests.

Dewatering

Dewatering was simulated in a Schopper Riegler freeness tester, fixing the volume to be reached at 39° SR and measuring the time it took to reach the volume. The initial mass was 2.3 g (2.3 g/liter) and dewatering was measured at different pH's for stock samples prepared with aluminum sulfate as well as stock samples prepared with CO2. The results were:

| DEWATERING TIME (seconds) | | |
|---|---|---|
| pH | $A1_2(SO_4)_3$ | $CO_2$ |
| 6.6 | 18.8 | 18.3 |
| 5.5 | — | 14.9 |
| 5.0 | — | 14.5 |
| 4.5 | 16.4 | — |

At pH 6.6, the dewatering time of the pulp made with $CO_2$ was essentially the same as that of the pulp made with aluminum sulfate. As pH was lowered, the dewatering time of the $CO_2$-made pulp was significantly reduced. In fact, even when the pH of the alum-made pulp was reduced a full point below that of the $CO_2$-made pulp, the dewatering time of the alum-made pulp was higher. These tests indicate that the $CO_2$-made pulp drains faster than the alum-made pulp. Thus, either productivity can be increased or drying economics can be improved.

Sizing tests were conducted using pulp with the same composition and degree of refining as that in the dewatering tests. Hand sheets were made with a basis weight corresponding to 130 g/m$^2$.

The results were as follows:

| Cobb ($gH_2O/m^2$ of sheet) | | | |
|---|---|---|---|
| Rosin Size Consumption | $(A1_2SO_4)_3$ | $CO_2$ | |
| (dry kg/ton) | (pH = 4.5) | (pH = 5.5) | (pH = 5.0) |
| 0 | 114 | 122 | 114 |
| 0.05 | 109 | 106 | 73 |
| 0.10 | 84 | 103 | 62 |
| 0.15 | 50 | 80 | 51 |
| 0.20 | 56 | 78 | 49 |
| 0.25 | 45 | 64 | 63 |
| 0.30 | 50 | 24 | 63 |

From these tests it was determined that the proper level of sizing is maintained when using $CO_2$ in place of additional aluminum sulfate. That is, even though freeness is improved when using $CO_2$, the rosin size is still retained with the paper product to the same degree as it is retained in the alum-made paper product.

| APPENDIX | |
|---|---|
| Acid size | A size used in acid papermaking. A common acid size is rosin. Typically, aluminum sulfate is used to fix the size in acid sized papers. See aluminum sulfate and size. |
| Alum | See aluminum sulfate. |
| Aluminum Sulfate | A filler in the acid papermaking process that reduces pH, adds bulk to the sheet, fixes additives such as dyes and rosin sizing, improves retention of fillers and fines, and improves drainage. Also called alum or papermaker's alum. |
| Cleaners | Devices used to remove dirt or other contaminants from a pulp slurry. |
| Cobb test | A test (Tappi test method T441) to measure the ability of a piece of sized paper to resist water. Higher Cobb numbers represent greater absorption of water and therefore less resistance to attack by water. |
| Drainage | The process of draining water from a pulp slurry through a screen. Drainage occurs on the Fourdrinier and can be measured by freeness. See freeness. |
| Headbox | A flow chamber located at the head end of a Fourdrinier. It receives the diluted pulp stock slurry and regulates the head or level to |

-continued

| APPENDIX | |
|---|---|
| | provide a uniform flow across the width of the wire. |
| Fan pump | A large centrifugal pump used to pump and mix pulp stock and large quantities of dilution water to the headbox of the paper machine. |
| Fourdrinier | The main drainage section of a paper machine, directly downstream of the headbox. The Fourdrinier is typically a wire or plastic mesh screen that drains water from the pulp slurry. |
| Freeness | The ability of a pulp and water mixture to release or retain water. |
| Freeness tester | A device for measuring freeness. |
| Furnish | The materials in a pulp stock mixture such as the various pulps, dyes, additives, and other chemicals blended together in the stock preparation area of the paper mill and fed to the wet end of the paper machine. Also called stock or pulp furnish. |
| Internal Sizing | The process of adding suitable chemicals to sizing a papermaking stock slurry which precipitate on the fibers to control the penetration of liquids into paper or paperboard made from it. See size and surface sizing. |
| Kraft | 1. A chemical process for cooking wood chips to produce a wood pulp. 2. An unbleached paper product made using the Kraft process. Examples of Kraft products are grocery bags and cardboard. |
| Mordant | Materials added to pulp slurries to improve the fixation of fillers, such as starches and dyes, to the fiber. |
| Paper machine | A machine used to make paper or board from a furnish. Machines usually include the following functional stages: draining, pressing, drying, coating, and winding. |
| Paper machine approach system | The series of tanks, refiners, cleaners, pumps, etc. that precede the paper machine. Also called approach system. |
| Paper product | A general term covering both paper and board. Some examples are printing and writing papers, newsprint, cardboard, linerboard and corrugating medium. |
| Papermaking | The process of converting furnish into paper or board which includes a number of operations some of which are, refining, blending, screening, water removal, pressing, drying, and winding. |
| Refiner | A machine for mechanically treating fibers by rubbing, crushing, fraying, or cutting. Refiners succeeded beaters. Also called ticklers. |

-continued

| APPENDIX | |
|---|---|
| Retention | Refers to the ability of the pulp slurry to retain fibers and fillers rather than allowing them to drain through the wire and consequently be removed from the final paper product. |
| Rosin | A common sizing agent. See size. |
| Sizing agent | Substances, such as rosins, gelatins, glues, starches, waxes, etc., added to paper stock furnish or the surface of the sheet goods made from it to impart ink- and water-repelling properties. |
| Stock | A mixture of pulp which may or may not contain fillers, additives and dyes used to make a paper product. Also called furnish. |
| Wastepaper | Paper or board that is returned to the mill to serve as a source of fiber for subsequent paper product manufacture. |

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An acid-based method for manufacture of a paper product, comprising the steps of:

providing a supply of pulp derived from wastepaper, said pulp containing an acidic aluminum compound; and adding carbon dioxide to said supply of pulp to reduce the pH of said supply of pulp to a level of acidity which allows dissolution of said aluminum compound.

2. The method as recited in claim 1, wherein said aluminum compound comprises aluminum sulfate.

3. The method as recited in claim 2, wherein sufficient carbon dioxide is added to said supply of pulp to reduce the pH thereof to a level which enables said aluminum sulfate to react with available sizing agent to achieve a desired sizing of a final product.

4. The method as recited in claim 2, wherein all pulp in said supply of pulp is derived from wastepaper.

5. The method as recited in claim 2, wherein sufficient carbon dioxide is added to avoid a need for an addition of supplemental amounts of said aluminum sulfate.

6. The method as recited in claim 2, further comprising the step of adding a supplemental amount of said aluminum sulfate to said supply of pulp, wherein said supplemental amount of said aluminum sulfate is sufficient to achieve a desired sizing of a final product, but less than the amount of said aluminum sulfate that would be required in an absence of said carbon dioxide.

* * * * *